US005379666A

United States Patent [19]

Held

[11] Patent Number: 5,379,666

[45] Date of Patent: Jan. 10, 1995

[54] REPLACEMENT APPARATUS FOR FLUORESCENT BULBS

[76] Inventor: James H. Held, 13303 Marceline, San Antonio, Tex. 78232

[21] Appl. No.: 156,022

[22] Filed: Nov. 19, 1993

Related U.S. Application Data

[62] Division of Ser. No. 982,956, Nov. 30, 1992, Pat. No. 5,330,243.

[51] Int. Cl.[6] ..... H01K 3/32

[52] U.S. Cl. ..... 81/53.1; 81/53.11; 294/19.1; 294/99.1

[58] Field of Search ..... 81/53.1, 53.11, 53.12; 294/19.1, 19.2, 22, 99.1

[56] References Cited

U.S. PATENT DOCUMENTS 3,143,371 8/1964 Bloch et al. ..... 81/53.11
3,929,365 12/1975 Hunt et al. ..... 81/53.12

*Primary Examiner*—D. S. Meislin
*Attorney, Agent, or Firm*—Cox & Smith Incorporated

[57] ABSTRACT

A bulb grasping unit for an elongated cylindrical fluorescent bulb is mounted on an elongated handle to facilitate replacement of fluorescent bulbs in out of reach fixtures. The bulb grasping unit is resiliently radially expansible to snap into engagement with the bulb.

1 Claim, 3 Drawing Sheets

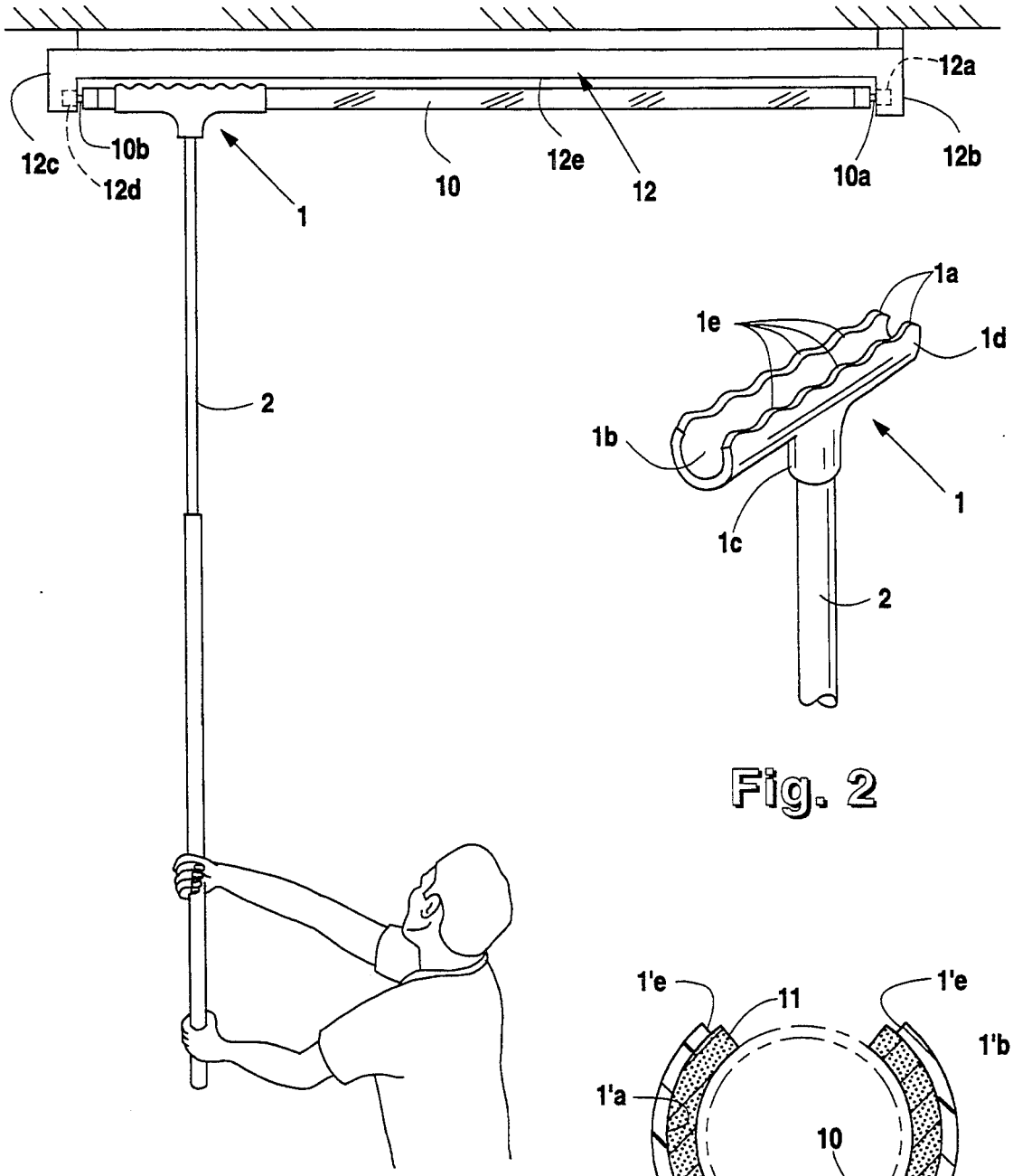
Fig. 1
Fig. 2
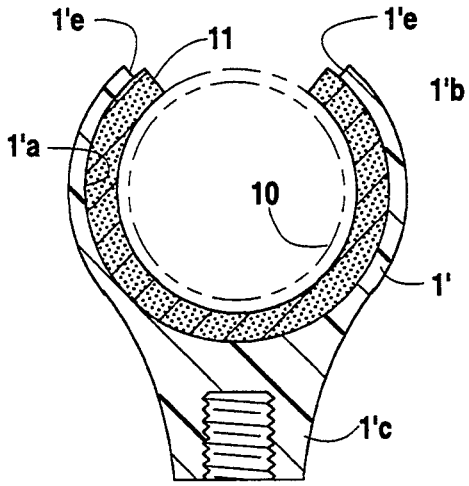
Fig. 3

REPLACEMENT APPARATUS FOR FLUORESCENT BULBS

This application constitutes a division of application Ser. No. 07/982,956 filed Nov. 30, 1992 now U.S. Pat. No. 5,330,243.

BACKGROUND OF THE INVENTION

1. Field of the Invention

The invention relates to apparatus for installing and removing elongated, cylindrical fluorescent bulbs into or out of their customary supporting fixtures. The invention has particular application in fluorescent lighting systems involving axially directed, spring type retaining sockets for mounting tubular fluorescent bulbs.

2. Summary of the Prior Art

As is well known, the installation and removal of fluorescent bulbs is usually accomplished with much inconvenience. In the normal situation, fluorescent bulbs are supported in fixtures at an overhead location out of reach of the normal size person. Hence, an elevated platform or ladder is needed to place the maintenance person within reach of the particular fixture needing a bulb change. Since many fluorescent bulbs range in length from six to eight feet, it is difficult for the maintenance person to climb up a ladder holding the bulb, then align one end of the bulb with the spring type retaining socket, apply an axial force to the bulb to compress the socket, and then swing the other end of the bulb into engagement with the other socket.

It has been previously proposed that grasping units for holding a fluorescent bulb be secured to the end of an elongated handle to permit the replacement of the bulb without resort to a ladder. Bulb grasping units of this type are shown in the following U.S. Patents:

| | |
|---|---|
| #2,393,880 | Beard |
| #2,589,642 | Stueland |
| #2,855,238 | Ford |
| #3,101,212 | Cater |
| #3,929,365 | Hunt et al |

In all of the aforementioned prior art patents, except the Hunt et al patent, elaborate mechanisms are provided generally incorporating two semi-cylindrical grasping elements which are moved relative to each other in surrounding, clamping relationship relative to a fluorescent bulb by the operation of a complex linkage. Obviously, these constructions are expensive to manufacture and require frequent repair due to the number of moving parts involved in such prior art apparatuses.

The Hunt et al U.S. Pat. No. 3,929,365 discloses a simpler arrangement for grasping a fluorescent bulb, having either one or two connector prongs, comprising a semi-cylindrical gripper. A complex coupling is provided between the gripper and the operating handle to permit rotation of the bulb for insertion of a two prong type. The Hunt et al construction is obviously expensive to manufacture.

It is readily apparent, therefore, that a fluorescent bulb handling mechanism involving a minimum of movable parts, yet assuring the firm securement of the bulb during an installation or removal operation, would be a highly welcomed mechanism for installing or removing elongated fluorescent bulbs.

SUMMARY OF THE INVENTION

This invention provides a fluorescent bulb grasping element having a generally semi-cylindrical configuration. The grasping element is mounted on the end of an elongated handle, which may incorporate a conventional mechanism for adjusting the effective length of such handle. When so mounted, the axis of the semi-cylindrical grasping member is perpendicular to the axis of the elongated handle.

The grasping element is formed from a semi-rigid, yet resiliently flexible material which could be either metal or a suitable plastic such as polypropylene. While the bulb grasping unit is of generally semi-cylindrical configuration, along its axial length, portions of the longitudinal edges of the bulb grasping unit are arcuately extended to encompass slightly more than half of the diameter of the fluorescent bulb to be grasped. Thus, to apply the grasping unit to the bulb, it is only necessary to radially push the grasping unit against the bulb whereby the arcuate extensions on the grasping unit will be resiliently flexed outwardly to permit entry of the bulb into the recess defined by the grasping unit and to be secured therein.

In a preferred embodiment of the invention, the grasping unit comprises an outer body element formed of a solid, yet flexible material which defines a semi-cylindrical recess having a radius greater than that of the bulb to be grasped. A layer of foam is then inserted in the recess of the bulb grasping unit to provide a cushioned support for such bulb and increased frictional engagement. Again, however, arcuate extensions are provided along the axial edges of the bulb grasping unit, which encompass the bulb by more than 180° and hence effect a securement of the bulb within the foam covered recess.

With either of the two aforedescribed embodiments of the invention, the grasped bulb may be readily raised so that the single contact prong on one end of the bulb is engagable with a spring pressed female contact in the brackets that support the fluorescent bulb. The grasped bulb is pivoted upwardly while maintaining an axial force thereon to compress the spring biased female contact and bring the second prong on the bulb in alignment with the second female contact. The axial force on the bulb is then released, permitting the bulb to be moved axially to engage the other female contact and to be inserted therein.

A further embodiment of this invention is particularly useful in inserting or removing fluorescent bulbs from fixtures having brackets which define a vertically inclined camming surface leading upwardly from the bottom of the bracket to the vicinity of the female contact. For this type of fluorescent mounting apparatus, the bulb grasping element embodying this invention additionally incorporates a rotatable cam mounted on the end of a plunger which projects axially out of a lower portion of the tube grasping element in generally parallel relationship to the bulb. As shown in FIG. 3, projections 1*e* are preferably formed to impart a wave-like configuration to the opposed longitudinal edges 1*d*. Such plunger is normally held in a projecting position compressing a spring within a spring mounting recess, by the operation of a latch which is vertically shiftable. In such position, the cam rolls up the vertically inclined camming surface after insertion of the first contact prong in the spring pressed female contact. As the bulb is pivoted upwardly the spring pressed female contact is compressed by the cam and plunger acting on the bulb grasping unit.

In the locking position of the latch, the top of the latch is adjacent the bottom surface of the fluorescent bulb held in the tube grasping unit. When the bulb is pivoted upwardly, the bottom wall of the supporting fixture is contacted by the bulb, thus preventing further upward movement and shifting the latch downwardly. Preferably, a patch of material having an adhesive backing is applied to the bulb and engages the aforesaid bottom fixture wall to position the bulb so that the second contact prong of the bulb is in vertical alignment with the female prong provided in the second bracket of the mounting fixture. Thus, when further upward movement of the bulb is prevented by engagement of the patch of material with the bottom wall of the fixture, the upward force exerted by the bulb grasping unit will cause the latch to be moved downwardly, thereby contracting the plunger by the force of the compressed plunger spring to permit axial movement of the bulb grasping unit to engage the second contact prong of the bulb in the second female contact, thus securing the bulb in the female contacts.

A burnt out fluorescent bulb may be readily removed from the fixture by any of the embodiments of this invention. With any embodiment, the bulb is grasped in its medial portion by applying the grasping unit to the bulb and exerting sufficient upward force on the grasping unit, through the elongated handle, to spread the retention prongs of the grasping unit and permit it to snap into snug engagement with the bulb. An axial force in the direction of the spring pressed female contact element is then applied to the bulb, which effects the release of the contact prong on the opposite end of the bulb. The bulb is then pivoted downwardly and removed from the spring pressed female contact.

The invention, in all of its embodiments, is much simpler than any of the prior art structures, hence more economical to manufacture and to maintain.

Further advantages of the invention will be readily apparent to those skilled in the art from the following detailed description, taken in conjunction with the annexed sheets of drawings, on which is shown several preferred embodiments of the invention.

BRIEF DESCRIPTION OF DRAWINGS

FIG. 1 is a perspective view illustrating the insertion of an elongated fluorescent bulb into a supporting fixture by a bulb grasping unit embodying this invention.

FIG. 2 is a perspective view of one embodiment of bulb grasping unit embodying this invention.

FIG. 3 is an enlarged scale vertical sectional view of a modification of the bulb grasping unit of FIG. 2.

DESCRIPTION OF PREFERRED EMBODIMENTS

Figure 4:
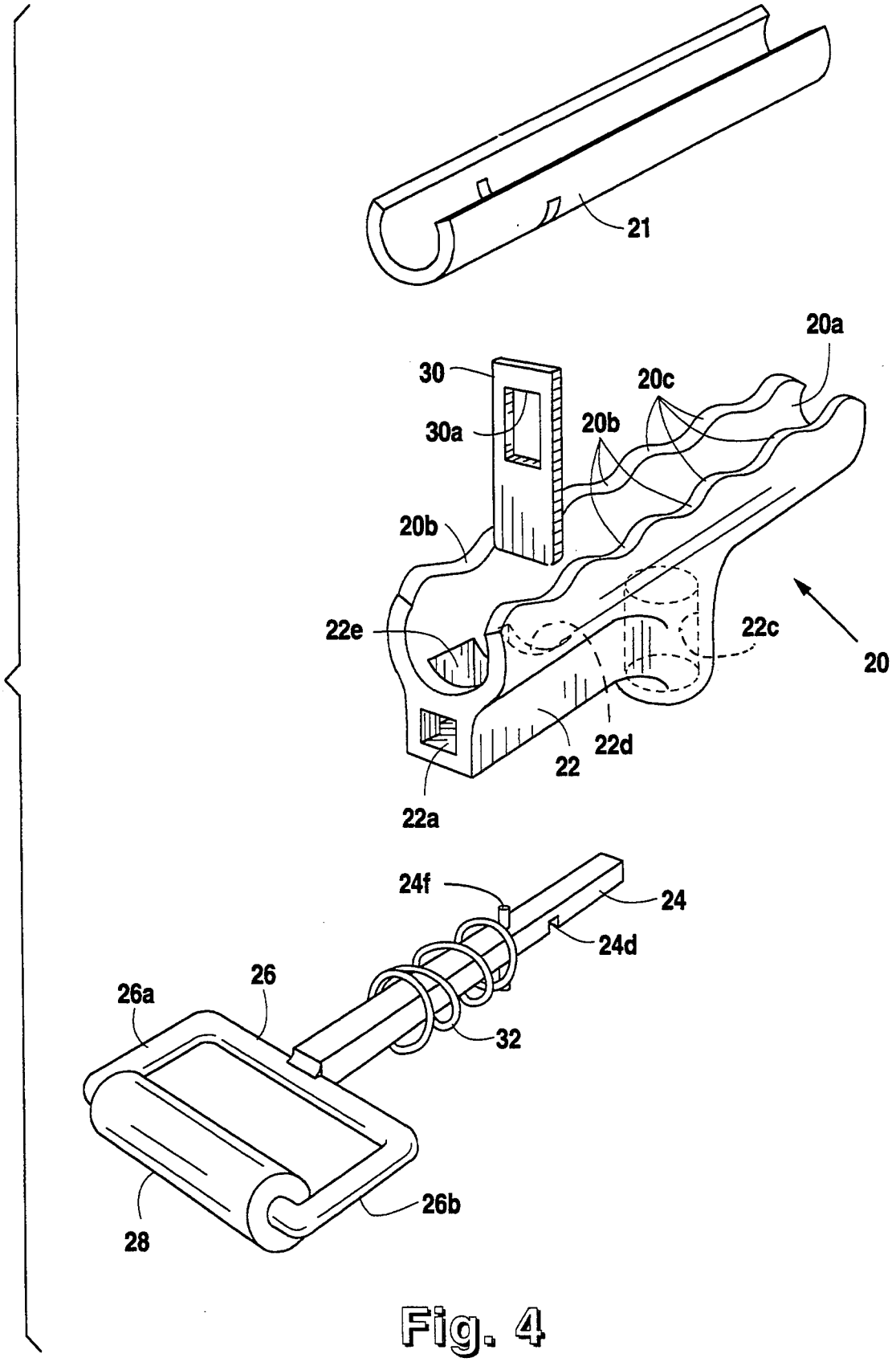
FIG. 4 is an enlarged scale exploded perspective view of another modified grasping unit embodying this invention.

Referring to FIGS. 1 and 2, there is disclosed the simplest form of a replacement apparatus for elongated cylindrical fluorescent bulbs embodying this invention. The apparatus comprises a generally semi-cylindrical bulb grasping unit 1 having opposed longitudinal edge walls 1*a*. The unit 1 is suitably rigidly mounted in transverse relation on the end of a elongated pole 2. Pole 2 may be of the type utilizing a plurality of telescopic members to permit selective elongation of the pole to a desired length. Such adjustable elongated poles are well known in the art and hence, will not described in detail.

The bulb grasping unit 1 is provided with an integral hub 1*c* which may be internally threaded for receiving a cooperating threaded end of the elongated handle 2. Alternatively, spring pressed balls or a bayonet type attachment may be employed.

The bulb grasping unit 1 is formed from a semi-rigid, yet resiliently flexible material such as aluminum, steel or an injection moldable plastic, such as polypropylene. The shell 1*d* of grasping unit 1 defines a semi-cylindrical recess 1*b* having a radius substantially equal to, but not less than the radius of the fluorescent bulb 10 to be grasped. Along the longitudinal edges 1*b*, a plurality of opposed arcuate projections 1*e* are formed which extend the semi-cylindrical recess 1*b* to slightly more than 180°. Thus, when the shell 1*d* of the bulb grasping unit 1 is forced radially against a wall of a fluorescent bulb 10, the shell 1*d* is expanded by resilient deflection of the arcuate extending portions 1*e* to snap into surrounding engagement with the fluorescent bulb 10 as shown in FIG. 1. Preferably, the arcuate projections 1*e* comprise a plurality of scallops disposed along each edge 1*a* to prevent tilting when initially engaged with the bulb.

The utilization of the bulb grasping unit 1 is illustrated in FIG. 1. The grasping unit 1 is snapped into engagement with a medial portion of the bulb 10, preferably adjacent one end, and the other end of the bulb 10 having a single projecting contact prong 10*a* is moved into engagement with an axially shiftable spring pressed female contact 12*a* formed in a supporting bracket 12*b* of a fluorescent light fixture 12. See enlarged views of FIGS. 4 and 5 for clarity. A second bracket 12*c* is axially spaced from the first mentioned bracket 12*b* a distance corresponding to the length of the fluorescent bulb 10 and this bracket incorporates a female contact element 12*d* which may or may not be axially spring pressed. Brackets 12*b* and 12*c* are supported by a receptacle housing 12 having a bottom wall 12*e*.

With one prong 10*a* of the fluorescent bulb 10 inserted in the axially shiftable spring pressed female contact 12*a* , an axial force is applied to the fluorescent bulb 10 by manipulation of the handle 2, thus depressing the spring pressed female contact element 12*a*. The bulb is then pivoted upwardly to bring the second single prong contact 10*b* of the bulb 10 into alignment with the second female contact element 12*c*. The axial force exerted on the bulb is then released and the bulb 10 shifts in an axial direction to engage the second prong 10*b* in the female contact 12*d* of the second supporting bracket 12*d*. Thus, the bulb 10 is securely anchored in the fixture 12.

To remove the bulb 10, the sequence of steps is merely reversed. The grasping unit 1 is raised by the handle 2 to radially engage a medial portion of the fluorescent bulb 10. An axial force is then applied to the bulb 10 to effect the axial shifting of the spring pressed female contact 12*a*, thus permitting the second contact prong 10*b* of the bulb 10 to be removed from its cooperating female contact element 12*d*. The bulb then can be pivoted downwardly to remove the first prong 10*a* from the spring pressed female contact 12*a* and the bulb 10 then can be lowered to a point where it can be manually grasped by the maintenance person.

To protect the fluorescent bulb 10 from damage from the application of the grasping unit 1 thereto, the embodiment of this invention illustrated in FIG. 3 may be employed. In this embodiment, the grasping unit 1' defines a semi-spherical recess 1'*a* which is larger than the radius of the fluorescent bulb 10. This increase in clearance is provided to accommodate a layer 11 of a cushioning material, such as a polyurethane foam plastic. Again, the internal radius of the resulting semi-cylindrical recess defined by the inserted foam plastic is substantially less than the external radius of the fluorescent bulb 10, thereby permitting the arcuate prongs or projections 1'*e*, to secure the bulb grasping unit 1' in firm engagement with the external surface of the fluorescent bulb 10. The cushioning material 11 employed also increases the frictional engagement between a fluorescent bulb 10 and the internal surface of the grasping unit 1', thereby preventing the grasping unit 1' from sliding relative to the bulb 10 when the required axial force is applied to the bulb 10 to compress the female contact element 12*a*.

Figure 5:
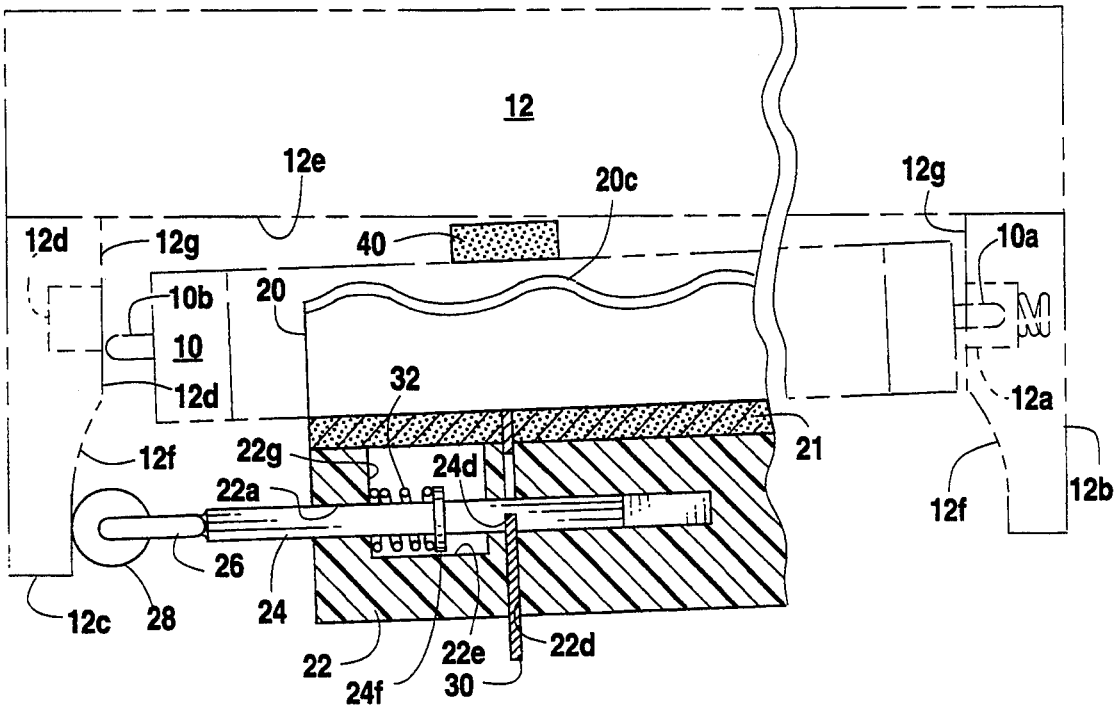
FIG. 5 is an enlarged scale vertical sectional view of the modified form of bulb grasping unit shown in FIG. 4, shown in assembled relationship to a fluorescent bulb and illustrating the position of the elements of the grasping unit as the bulb is moved to an inserting position in its supporting fixture.
Figure 6:
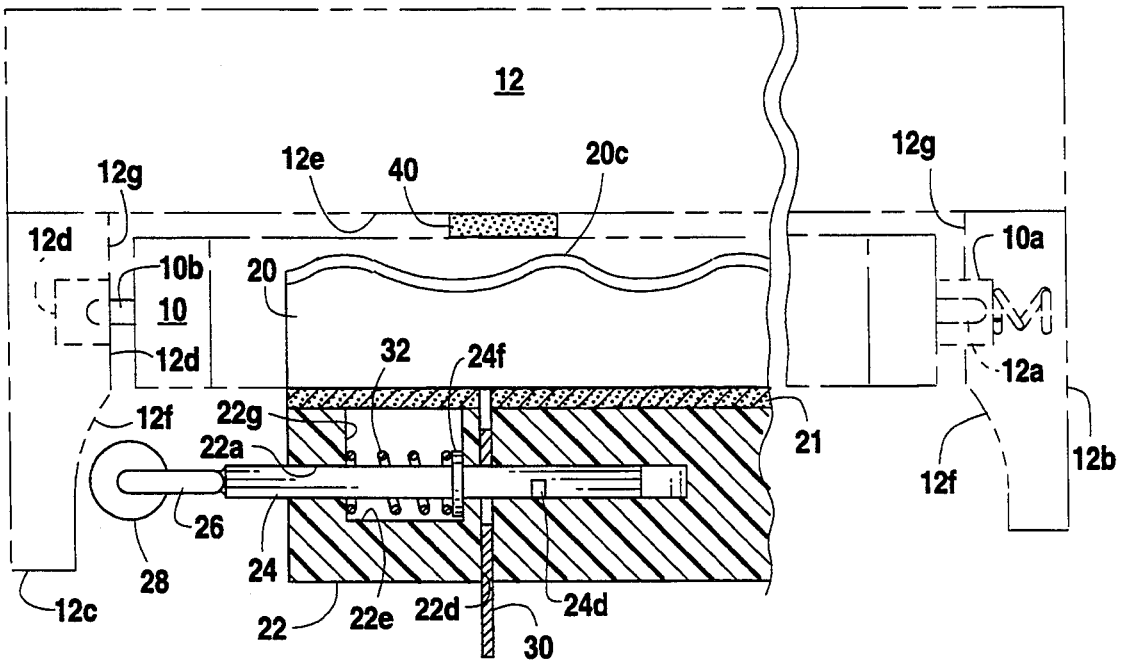
FIG. 6 is a view similar to FIG. 5 but illustrating the position of the elements of the bulb grasping unit when the bulb is completely inserted in its supporting fixture.

A third embodiment of the invention is illustrated in FIGS. 4–6. In this embodiment, the fluorescent tube grasping unit 20 defines an internal semi-cylindrical recess 20*a* having a radius substantially greater than the external radius of the fluorescent bulb 10 to be engaged. As in the modification of FIG. 3, a layer of cushioning and friction increasing material, such as a polyurethane foam 21, is inserted in the semi-cylindrical recess 20*a*. Arcuate prongs 20*c* are provided along each edge 20*b* of the semi-cylindrical recess 20*a* to extend the recess to slightly more than 180°, thereby insuring the securement of the fluorescent bulb 10 within the foam plastic lined recess 20*a*.

Additionally, the hub portion 20*c* of the tube grasping unit 20 is axially elongated as indicated at 22. An axially extending square bore 22*a* is provided in such hub portion 22 and opens in one end of the hub 22.

A plunger 24 is slidably mounted in the bore 22 and the outer end of the plunger 24 mounts a U-shaped bracket 26 having spaced arms 26*a* and 26*b* between which a cam roller 28 is rotatably journalled. Cam roller 28 is normally engaged with an upwardly inclined camming surface 12*f* (FIG. 5) conventionally provided on the bulb mounting brackets 12 which terminates in a planar surface 12*g* which is disposed in juxtaposition to an end face of the bulb 10 when the bulb 10 is installed in the female contact units 12*a* and 12*b*.

The cam mounting plunger 24 is normally secured in its outwardly projecting position shown in FIG. 5 by a vertically shiftable latch element 30 which is best shown in the exploded view of FIG. 4. Latch element 30 is of rectangular configuration and has a rectangular recess 30*a* surrounding plunger 24. Latch 30 is vertically shiftable in a correspondingly shaped slot 22*d* formed in the axially extended hub portion 22 and traversing the bore 22*a* within which the cam plunger 24 is mounted.

Cam plunger 24 is provided with a notch 24*d* which engages one edge of the rectangular slot 30*a* formed in the latch element 30. A recess 22*e* is formed in the hub portion 22 traversing the plunger mounting bore 22*a*. A spring 32 is mounted in surrounding relationship to the cam plunger 22 and is compressed between a vertical wall 22*g* (FIG. 5) of the recess 22*c* and a pin 24*f* transversely secured to the cam mounting plunger 24. Thus, in the position of latch element 30 shown in FIG. 5, the cam mounting plunger 24 is essentially rigidly mounted to the tube grasping unit 20 which, in this embodiment of the invention, is engaged with the fluorescent bulb 10 at a location adjacent one end of such fluorescent bulb. At least one spring pressed female contact 12*a* is provided in the mounting fixture 12 and when the prong 10*a* of the other end of bulb 10 is inserted in female contact 12*a* and the first bulb end pivoted upwardly, the cam 28 engages the vertically inclined camming surface 12*f* formed on the bracket opposed to the spring pressed female contact.

Thus, to insert a bulb between the opposed brackets 12*b* and 12*c*, the end of the bulb 10 opposite to the end grasped by the grasping unit 20 is first manipulated to insert the prong 10*a* into the spring pressed contact element 12*a*. The fluorescent tube 10 is then pivoted upwardly by manipulation of the handle 2 and the cam roller 28 rolls upwardly against the vertically inclined camming surface 22*f* provided on the opposed bracket 22*c* to axially shift the spring pressed contact element 12*a* and permit the second prong 10*b* of the fluorescent bulb to clear the inner face 12*g* of the bracket 12*c*.

To assist in alignment of the second prong 10*b* with the second female contact element 12*e*, this invention contemplates the utilization of a small pad 40 of foam or cloth having a thickness sufficient to position the prong 10*b* in substantially exact vertical alignment with the female contact 12*e* in the second bracket 12*c* by engagement of such pad with the bottom wall surface 12*e* of the supporting housing 12*d*.

When the bulb 10 is thus positioned, the latch 30 is pushed downwardly through the application of the upward force to the bulb grasping unit 20, thereby depressing the latch 30 to free the latch 30 from the notch 24*d* formed in the cam mounting plunger 24, as shown in FIG. 6. The cam mounting plunger 24 is then pushed inwardly by spring 32 to disengage from the camming surface 12*f* of the adjacent bracket 12*c*. The grasping unit 20 is then free to be moved axially toward the second bracket 12*c* to engage the second prong 10*b* in the second female socket 12*e*, thus securing the bulb in the female sockets.

To replace a burned out bulb, the plunger 24 is placed in its spring retracted position, and the same removal procedure is employed as previously described in connection with the modifications of FIGS. 1–3.

What is claimed and desired to be secured by Letters Patent is:

1. Apparatus for inserting cylindrical fluorescent bulbs in axially spaced sockets mounted in out of reach overhead locations on a housing having a downwardly facing wall between said sockets, said bulbs being of the type having a single central rigid contact prong projecting axially from each end of the bulb; said sockets defining axially aligned tubular contacts for respectively receiving said prongs, at least one of said tubular contacts being axially spring biased toward the other prong, comprising:

an elongated tubular handle;

a one piece bulb grasping unit formed by molding of a semi-rigid, resiliently deformable plastic material;

said grasping unit defining a socket for rigidly securing one end of said handle therein;

said bulb grasping unit being elongated along an axis perpendicular to the axis of said tubular handle and being of generally semi-cylindrical cross-section with diametrically opposed longitudinal edges; said longitudinal edges having a wave-like configuration to produce a recess of generally semi-cylindrical cross-section coaxial with said axis; said longitudinal edges having axially spaced, arcuate portions thereof with an arcuate extent slightly greater than 180°.

the internal radius of said recess being substantially equal to, but not less than the external radius of said fluorescent bulb, whereby said fluorescent bulb can be secured in, or removed from said recess by a generally radial movement of said grasping unit relative to a fluorescent bulb to resiliently deform said axially spaced arcuate portions of said recess; and said tubular handle having a length sufficient to move a grasped bulb to or from an axially aligned position relative to said sockets without requiring a ladder.

* * * * *